United States Patent [19]

Ryan

[11] Patent Number: 4,915,300

[45] Date of Patent: Apr. 10, 1990

[54] HIGH PRESSURE MIXING AND SPRAY NOZZLE APPARATUS AND METHOD

[76] Inventor: John Ryan, P.O. Box 20, Morenci, Ariz. 85540

[21] Appl. No.: 308,480

[22] Filed: Feb. 10, 1989

Related U.S. Application Data

[62] Division of Ser. No. 87,211, Aug. 20, 1987, Pat. No. 4,809,911.

[51] Int. Cl.[4] ..... B05B 9/00; B05B 7/04

[52] U.S. Cl. ..... 239/9; 239/267; 239/427.5; 239/434.5

[58] Field of Search ..... 239/427–427.5, 239/9, 124, 267, 398, 434.5; 417/163, 165, 166, 174, 167, 168

[56] References Cited

U.S. PATENT DOCUMENTS 1,879,366 4/1930 Lorraine ..... 417/163

FOREIGN PATENT DOCUMENTS 153905 10/1982 Fed. Rep. of Germany ..... 417/174

*Primary Examiner*—Andres Kashnikow
*Assistant Examiner*—William Grant
*Attorney, Agent, or Firm*—Victor Flores

[57] ABSTRACT

Disclosed is a high pressure mixing and spray nozzle apparatus generally comprised of three modules. The high pressure nozzle produces a more definite stream with less flair through the use of a linear compressed shock wave. The high pressure nozzle requires less fluid and less pressure for a proper spray. The three modules can be used alone or in different combinations to produce the desired results.

10 Claims, 2 Drawing Sheets

HIGH PRESSURE MIXING AND SPRAY NOZZLE APPARATUS AND METHOD

This is a divisional of application Ser. No. 087,211, filed Aug. 20, 1987, now U.S. Pat. No. 4,809,911.

BACKGROUND OF THE INVENTION

1. Field of the Invention

The present invention generally relates to an improved high pressure nozzle apparatus and, more specifically, to a high pressure nozzle apparatus which produces a linearly compressed definite spray with less flair than that which normally accompanies high pressure nozzles.

2. Description of the Prior Art

In the past spray guns were developed to combine a high pressure fluid with a low pressure fluid for discharge through a nozzle. Improvements in nozzle designs restricted the wide spray from nozzle outputs and diverted nozzle back pressure. However, the conventional nozzles still produced sprays with wide flair and insufficient acceleration. A problem still exists in obtaining a high pressure accelerated spray nozzle for use in fire-fighting and industrial applications.

Warnock (U.S. Pat. No. 1,007,162) discloses a mixing and discharging nozzle. In the operation of the nozzle, gas and air are combined in an air chamber, then discharged through the nozzle. Uhri (U.S. Pat. No. 1,751,719) teaches a more efficient nozzle which requires less pressure for proper operation. The nozzle required a restricted stream of high pressure fluid aligned and concentrical with an elongated discharge tube of an increasing diameter. The restricted stream of high pressure fluid was surrounded by a larger amount of low pressure fluid which formed an envelope around the high pressure air jet, resulting in the mixing of the two fluids along their contacting surface area permitting atomization. Kadosch (U.S. Pat. No. 2,738,646) discloses a flow control method which utilizes a convex wall at the inlet passage designed to deflect any upstream gases towards the flow and an obstacle at the inlet passage which laterally deflected the upstream flow towards the convex wall. Scheurer (U.S. Pat. No. 2,259,215) teaches a dual component spray gun which includes a primary component turbo-type nozzle and which discharges the secondary component slightly upstream of the exit orifice. McNulty et al. (U.S. Pat. No. 2,555,238), akin to Scheurer, teach a turbo-type dual component spray gun. Nulph (U.S. Pat. No. 2,526,265) discloses a spray head which includes a plurality of jet discharge openings which are designed to spray fluid from the head in all directions.

However, despite the improvements, spray nozzles still produce a turbo discharge with flair, and an output of insufficient pressure and acceleration for many applications. Accordingly a need still remains for a nozzle which produces a high pressure accelerated spray with less flair as disclosed herein.

SUMMARY OF THE INVENTION

It is an object of this invention to provide an improved nozzle apparatus which produces an accelerated high pressure output.

It is another object of this invention to provide an improved nozzle apparatus which produces a definite spray in a state of linear compression.

It is a further object of this invention to provide an improved nozzle apparatus which can use less fluid and which is more forceful than conventional nozzles.

It is a still further object of this invention to create a nozzle apparatus comprised of three modules, each of which can be used separately or in varied combinations for maximum effect in differing applications.

It is still another object of this invention to provide an improved nozzle apparatus which may be utilized in a variety of applications including fire extinguishing and control, erosion mining, material handling, surface and submarine digging, heat and flame repression, ditch and/or pipe cleaning, etc.

The foregoing and other objects, features and advantages of this invention will be apparent from the following, more particular, description of the preferred embodiments of this invention, as illustrated in the accompanying drawings.

DESCRIPTION OF THE PREFERRED EMBODIMENT

Figure 1:
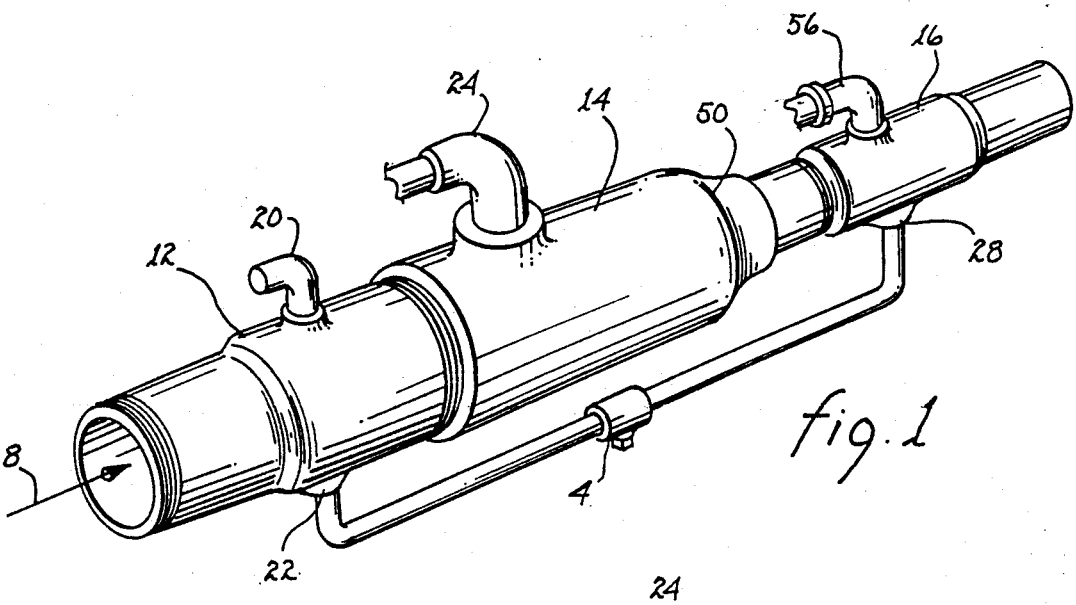
FIG. 1 a perspective view of the high pressure mixing and spray nozzle apparatus including a pressure/back pressure module, an expulsion chamber module, and an accelerator module.

Referring now to FIG. 1 of the accompanying drawings which set forth the present invention in greater detail and in which like numerals designate like features, a high pressure mixing and spray nozzle apparatus is generally comprised of a pressure/back pressure module 12, an expulsion chamber module 14, an accelerator module 16, each module having a secondary component inlet (20, 24 and 56, respectively), a diversion member 6, and a diversion control valve 4. A primary component, usually water under pressure, is introduced to the nozzle apparatus in the direction of the flow 8. Module 12 is termed pressure/back pressure due to the fluid mechanics action involved within module 12. In particular, the primary component is a pressurized fluid that is received within module 12 that has its flow restricted downstream by the narrower outlet end of module 12. This restriction creates a backpressure on incoming fluid.

Figure 2:
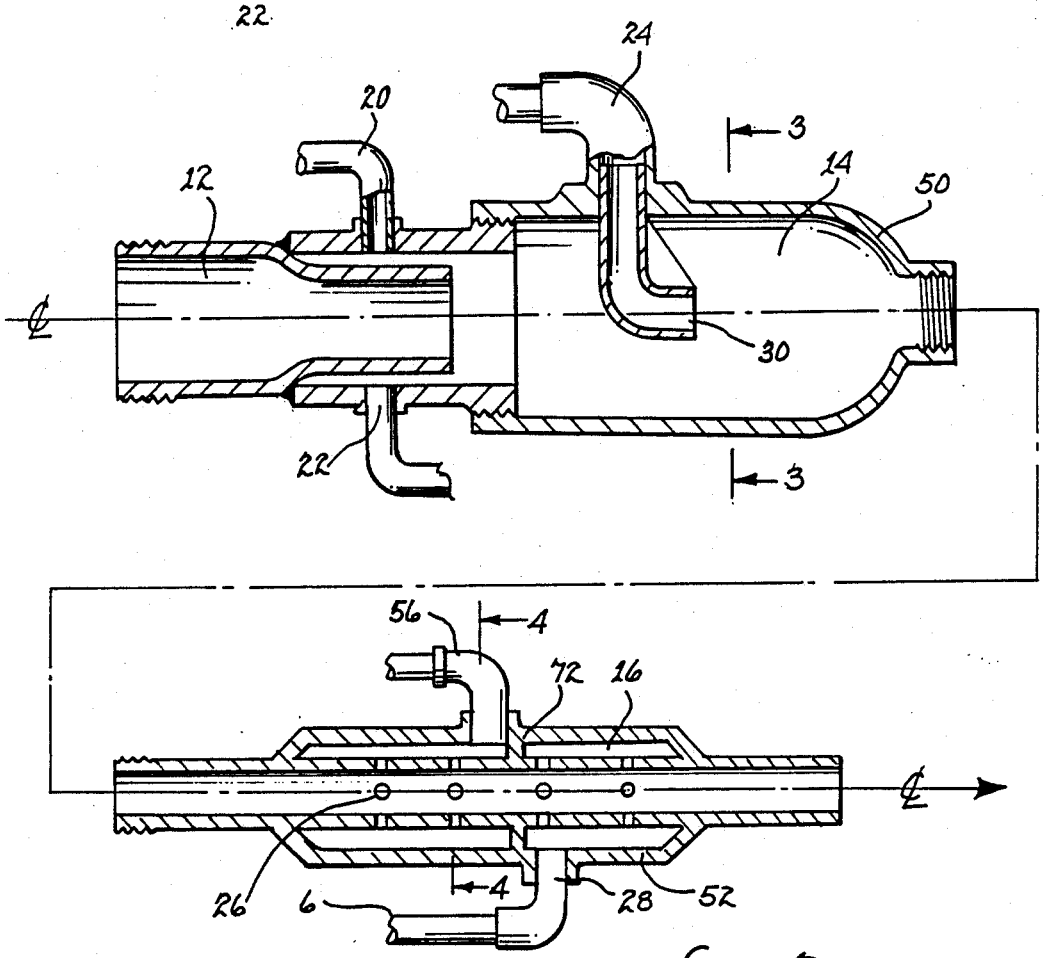
FIG. 2 is a disconnected cross-sectional views of the subject nozzle apparatus.

As best shown in FIG. 2, the pressure/back pressure module 12 contains a secondary component inlet 20 for introducing a small amount of air which circumferentially surrounds the flow of the primary component fluid through the feedline. The pressure/back pressure module 12 also provides a pressure inlet/outlet 22 for diversion of excess pressure to the accelerator module 16.

Figure 3:
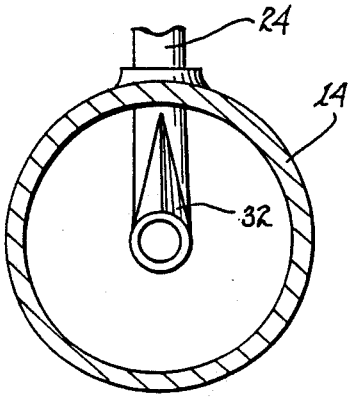
FIG. 3 is a cross-sectional view of one embodiment of an expulsion chamber module taken along line 3—3 of FIG. 2.
Figure 6:
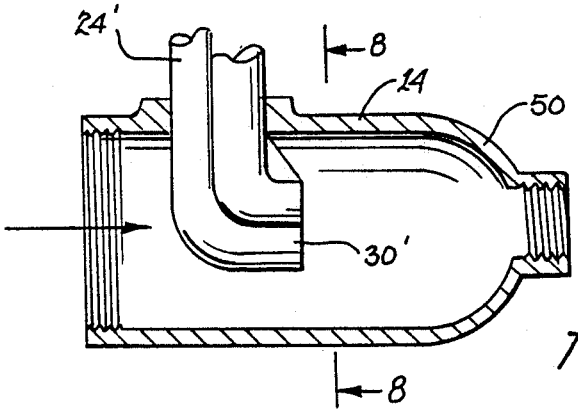
FIG. 6 is a cross-sectional view of one embodiment of an expulsion chamber module.
Figure 8:
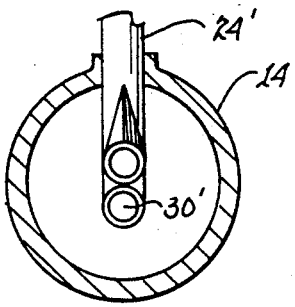
FIG. 8 is a cross-sectional view of one embodiment of an expulsion chamber taken along the line 8—8 of FIG. 6.

The secondary component inlet 24 of the expulsion chamber 14 provides a unidirectional fluid jet orifice 30. Fluid jet orifice 30, in combination with inlet 30, provides a means of pushing (or driving) the fluid through module 14, hence the term expulsion chamber module. The diameter of the unidirectional orifice 30 may be sized according to the viscosity of fluids to be used. The secondary component inlet 24 can be formed in a circular orifice 30, as shown in FIGS. 2 and 3. In another embodiment, the unidirectional jet orifice 30 can also consist of two adjacent circular outlets as best shown in FIGS. 6 and 8, this embodiment allows for the introduction of an additional secondary component through another secondary component inlet 24' and another unidirectional jet orifice 30'.

The secondary component inlet 24 is mounted on the expulsion chamber module 14 which is larger in diameter than the fluid line of the pressure/back pressure module 12 feeding it. The inner boundary of expulsion chamber module 14 is cylindrical in shape proceeding to a hemispheric-shaped portion 50 and an outlet which is of a significantly smaller diameter than the main portion of the expulsion chamber module 14. The hemispheric-shaped portion 50 serves to develop a linearly compressed shock-type wave, the import of which is discussed herein.

Figure 4:
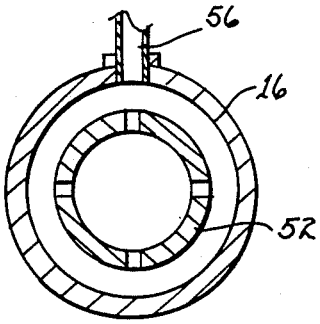
FIG. 4 is a cross-sectional view of one embodiment of an accelerator module taken along line 4—4 of FIG. 2.
Figure 5:
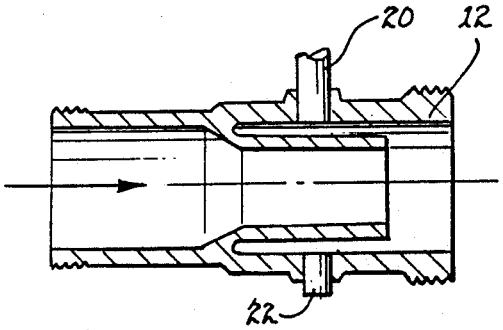
FIG. 5 is a cross-sectional view of a pressure/back pressure module.

The accelerator module 16 contains a secondary component inlet 56 and a pressure inlet/outlet 28 which is operably coupled to the diversion member 6. The accelerator module 16 also contains an inner member 52 which includes, in one embodiment, a plurality of radially oriented circular openings 26 located along the length of the inner member 52 (See FIG. 4). Inlet 56 and inner member 52 provide a means for compressing and sharpening the wave as it leaves expulsion chamber module 14 to increase the velocity and range of the oncoming fluid, hence to term accelerator module.

Figure 7:
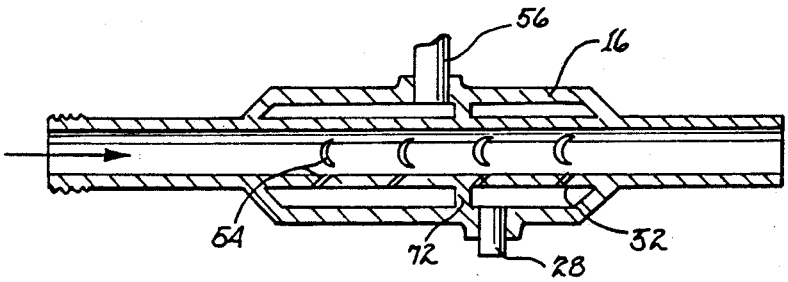
FIG. 7 is a cross-sectional view of one embodiment of an accelerator module.

In another embodiment best shown in FIG. 7, the inner member 52 may contain a plurality of slit shaped openings 54 instead of circular openings 26. The slit shaped openings 54 are angular cuts made on the wall of inner member 52, commencing with a series of slit shaped openings 54 cut at a predetermined angle with the wall of inner member 52. Subsequent series of slits 54 that are cut along the direction of the fluid flow are then cut having an angle with the wall of the inner that is lesser than the angle made with the wall of the inner member 52 of the previous series of slits 54. As shown in FIG. 7 and within the cross-section area of the inner wall member 52, the slits 54 are angular cuts that are formed by a cut having the outer surface of inner wall 52 cut slightly upstream of the inner terminating end of the slit 54 on the inner wall surface of inner wall member 52. This decrease in angle sharpens and accelerates the fluid waveform as it passes through the accelerator module 16.

The accelerator module 16 further comprises a circumferential wall 72, as shown in FIGS. 2 and 7. The circumferential wall 72 serves to separate the secondary component inlet 56 from the pressure inlet/outlet 28.

SYSTEM OPERATION

In the pressure/back pressure module 12, a small amount of air surrounds the flow of fluid by 360 degrees, adding momentum and pressure directionally into the expulsion chamber module 14. If the desired pressure level is exceeded the pressure can be diverted out of the pressure/back pressure module 12 and into the accelerator module 16.

The secondary component inlet 24 of the expulsion chamber module 12 aid in pushing the fluid through the expulsion chamber module 14 and towards the accelerator module 16. The unidirectional orifice 30 is centrally located to allow acceleration of the fluid and may be larger for use with a solid fluid and smaller for use with a gas or liquid fluid.

The unidirectional orifice 30 may also be eccentrically located, but directed at an angle toward the center line, to prevent clogging in the expulsion chamber module 14 when heavier materials are used. The unidirectional orifice 30 may be formed in a delta-wing shape 32 to further dampen any wave action around the secondary component inlet 24 by directing the fluid linearly through the expulsion chamber module 14.

The expulsion chamber module 14 is larger in diameter than the fluid line feeding it from the pressure/back pressure module 12. The required diameter of the expulsion chamber module 14 increases in relation to the increase in desired fluid volume and pressure. This increase in volume and decrease in pressure creates a draw from the secondary component inlet 24. The expulsion chamber module's 14 hemispherically-shaped portion 50 reduces a bell-shaped shock-type wave into a linearly compressed wave. The hemispherically-shaped portion 50 also limits the perpendicular lines of force thereby allowing directional acceleration through the expulsion chamber module 14.

As the fluid enters the expulsion chamber module 14 from the pressure/back pressure module 12 the fluid waveforms tend to diverge outward. Simultaneously, the fluid input from the unidirectional orifice 30 produces waveforms which tend to converge as they enter the expulsion chamber 14. These converging waveforms serve to offset and compress the angle of the diverging waveforms produced by the pressure/back pressure module 12, thereby producing a linearly compressed waveform. The outwardly expanding forces of the linearly compressed waveform further accelerates the fluid flow.

The accelerator module 16 is pressurized through the input 56, providing a unidirectional flow. The accelerator module 16 compresses and accelerates the mixture leaving the expulsion chamber module 14, further sharpening the wave leaving the expulsion chamber module 14 and increasing the velocity and range of the final output. The accelerator module 16 utilizes pressure and vacuum to draw the shock wave through the hemispherically-shaped portion 50 of the expulsion chamber module 14. The inner member 52 of the accelerator module 16 contains plurality of slits 54 or openings 26 which create a reduction in friction against the fluid flow which and accelerates the fluid flow. The decrease in angle of the slits 54 or openings 26 serves to further sharpen and accelerate the final output.

Each module performs the same function of sharpening and accelerating the nozzle output, but each produces different results. Therefore the modules can be used separately or in any combination which will produce the desired result for the required application. Depending on the amount of back pressure required, back pressure from any module can be diverted to any other module. Each module can also accommodate a gas, liquid, or solid fluid depending on the distinct needs and requirements of the function to be performed.

Further, the primary and secondary components may be varied to suit different situations. For example, for some fire-fighting situations, water would be the primary component with a dry chemical flame retardant being a secondary component and carbon dioxide being another secondary component. It will be understood that although the secondary components introduced in the pressure/back pressure module or the accelerator module are usually in gaseous form, such as air, liquid and solid fluids may likewise be introduced.

While the invention has been particularly shown and described in reference to the preferred embodiments thereof, it will be understood by those skilled in the art that changes in form and details may be made without departing from the spirit and scope of the invention.

I claim:

1. A modular high pressure nozzle apparatus comprising:

(a) a plurality of detachable modules for use therewith, each member module of said plurality of modules having at least one secondary inlet means for providing a primary component of a fluid mixture with a flow of a secondary component of said fluid mixture for adding forwardly directed momentum and pressure to said fluid mixture;

(b) one of said plurality of modules includes an expulsion chamber module adapted for receiving said primary component and said secondary component and accelerating and wave shaping said fluid mixture, said expulsion chamber module comprising:

(i) secondary inlet means provided with an orifice means for introducing said secondary component into said expulsion chamber module and pushing forwardly said fluid mixture; and (ii) a hemispherically-shaped means for developing said fluid mixture being pushed into a linearly compressed and accelerated wave of said fluid mixture prior to exiting said expulsion chamber module.

2. A modular high pressure nozzle apparatus as recited in claim 1 wherein said expulsion chamber module includes being adapted for delivering said fluid mixture to an accelerator module and further accelerating said fluid mixture, said accelerator module having a secondary inlet means coupled to an inner member means for introducing said secondary component and for producing a sharp and accelerated fluid mixture waveform upon exiting an outlet end of said accelerator module.

3. A modular high pressure nozzle apparatus comprising:

(a) a plurality of detachable modules for use therewith, each member module of said plurality of modules having at least one secondary inlet means for providing a primary component of a fluid mixture with a flow of a secondary component of said fluid mixture for adding forwardly directed momentum and pressure to said fluid mixture;

(b) one of said plurality of modules includes a pressure/back pressure module, said pressure/back pressure module comprising:

(i) a primary inlet means for accepting said primary component;

(ii) a hollow member means operably coupled to said inlet means for directing a flow of said fluid mixture therethrough, (iii) secondary inlet means cooperating with said hollow member means for surrounding said flow of primary component with a flow of a secondary component of said fluid mixture and for adding forwardly directed momentum and pressure, and (iv) a pressure module outlet means operably coupled with said hollow member means for discharging said fluid mixture;

(c) said pressure/back pressure module includes being adapted for delivering said fluid mixture to an expulsion chamber module and further accelerating and wave shaping said fluid mixture, said expulsion chamber module comprising:

(i) a secondary inlet means provided with an orifice means for introducing said secondary component into said expulsion chamber module and pushing forwardly said fluid mixture; and (ii) a hemispherically-shaped means for developing said fluid mixture being pushed into a linearly compressed and accelerated wave of said fluid mixture prior to exiting said expulsion chamber module.

4. A modular high pressure nozzle apparatus as recited in claim 3 wherein said expulsion chamber module includes being adapted for delivering said fluid mixture to an accelerator module and further accelerating said fluid mixture, said accelerator module having a secondary inlet means coupled to an inner member means for introducing said secondary component and for producing a sharp and accelerated fluid mixture waveform upon exiting an outlet end of said accelerator module.

5. A modular high pressure nozzle apparatus, comprising:

(a) a plurality of detachable modules for use therewith, each member module of said plurality of modules having at least one secondary inlet means for providing a primary component of a fluid mixture with a flow of a secondary component of said fluid mixture for adding forwardly directed momentum and pressure to said fluid mixture; and (b) one of said plurality of modules includes an accelerator module adapted for accelerating said fluid mixture, said accelerator module having a secondary inlet means coupled to an inner member means for introducing said secondary component and for producing a sharp and accelerated fluid mixture waveform upon exiting an outlet end of said accelerator module, said accelerator module includes:

said inner member means having a plurality of linearly spaced openings that produce said sharp and further accelerated fluid mixture wave form upon exiting said outlet end of said accelerator module.

6. A modular high pressure nozzle apparatus, in accordance with claim 5 wherein:

said linearly spaced openings comprises a series of slit-shaped openings.

7. A modular high pressure nozzle apparatus, in accordance with claim 5 wherein:

said linearly spaced openings comprises a series of circular-shaped openings.

8. A modular high pressure nozzle apparatus comprising:

(a) a plurality of detachable modules for use therewith, each member module of said plurality of modules having at least one secondary inlet means for providing a primary component of a fluid mixture with a flow of a secondary component of said fluid mixture for adding forwardly directed momentum and pressure to said fluid mixture;

(b) one of said plurality of modules includes a pressure/back pressure module, said pressure/back pressure module comprising:

(i) a primary inlet means for accepting said primary component, (ii) a hollow member means operably coupled to said inlet means for directing a flow of said fluid mixture therethrough, (iii) secondary inlet means cooperating with said hollow member means for surrounding said flow of primary component with a flow of a secondary component of said fluid mixture and for adding forwardly directed momentum and pressure, (iv) a pressure module outlet means operably coupled with said hollow member means for discharging said fluid mixture;

(c) said pressure/back pressure module includes being adapted for delivering said fluid mixture to an accelerator module and further accelerating said fluid mixture, said accelerator module having a secondary inlet means coupled to an inner member means for introducing said secondary component and for producing a sharp and accelerated fluid mixture waveform upon exiting an outlet end of said accelerator module, said apparatus; and (d) a diversion means for diverting excess pressure from said pressure/back pressure module to said accelerator module.

9. A method for providing a high pressure, accelerated fluid mixture for use in fire fighting and other fluid delivery related industrial applications that utilize high pressure nozzles, said method comprising the steps of:

(a) providing a fluid source, said fluid source comprising at least one fluid component, said at least one fluid component being designated a primary component of a fluid mixture;

(b) providing a modular high pressure nozzle apparatus, said apparatus comprising;

a plurality of detachable modules for use with said apparatus, each member module of said plurality of modules having at least one secondary inlet means for providing said primary component with a flow of a secondary component of said fluid mixture for adding forwardly directed momentum and pressure to said fluid mixture, said plurality of modules includes a pressure/back pressure module, said pressure/back pressure module comprising:

(i) a primary inlet means for accepting said primary component, (ii) a hollow member means operably coupled to said inlet means for directing a flow of said fluid mixture therethrough, (iii) secondary inlet means cooperating with said hollow member means for surrounding said flow of primary component with a flow of a secondary component of said fluid mixture and for adding forwardly directed momentum and pressure, and (iv) a pressure module outlet means operably coupled with said hollow member means for discharging said fluid mixture;

(c) adapting said pressure/back pressure module for delivering said fluid mixture to an expulsion chamber module for further accelerating and wave shaping said fluid mixture, said expulsion chamber means comprising:

(i) secondary inlet means provided with a orifice means for introducing said secondary component into said expulsion chamber module and pushing forwardly said fluid mixture, and (ii) a hemispherically-shaped means for developing said fluid mixture being pushed into a linearly compressed and accelerated wave of said fluid mixture prior to exiting said expulsion chamber module;

(d) providing a secondary component of said fluid mixture;

(e) inputing said provided first component to said primary inlet means;

(f) inputting said provided secondary component into respective secondary inlet means of said plurality of modules for providing said primary component with a flow of said secondary component; and (g) delivering a high pressure, accelerated fluid mixture.

10. A method of providing a high pressure, accelerated fluid mixture as recited in claim 9, wherein said step of providing a modular high pressure nozzle apparatus includes:

adapting said expulsion chamber module for delivering said fluid mixture to an accelerator module and further accelerating said fluid mixture, said accelerator module having a secondary inlet means coupled to an inner member means for introducing said secondary component and for producing a sharp and accelerated fluid mixture waveform upon exiting an outlet end of said accelerator module.

* * * * *